US009752470B2

(12) United States Patent
van den Heuvel et al.

(10) Patent No.: US 9,752,470 B2
(45) Date of Patent: Sep. 5, 2017

(54) APPLIED-IGNITION INTERNAL COMBUSTION ENGINE WITH VARIABLE VALVE DRIVE

(71) Applicant: Ford Global Technologies, LLC, Dearborn, MI (US)

(72) Inventors: Bas Lambertus van den Heuvel, Wijnandsrade (NL); Wilbert Hemink, Landgraaf (NL); Richard Fritsche, Herzogenrath (DE); Claudia Conee, Herzogenrath (DE); Werner Willems, Aachen (DE); Franz Arnd Sommerhoff, Aachen (DE); Christian Hans, Hergenrath (BE)

(73) Assignee: Ford Global Technologies, LLC, Dearborn, MI (US)

( * ) Notice: Subject to any disclaimer, the term of this patent is extended or adjusted under 35 U.S.C. 154(b) by 198 days.

(21) Appl. No.: 14/645,858

(22) Filed: Mar. 12, 2015

(65) Prior Publication Data

US 2015/0267573 A1 Sep. 24, 2015

(30) Foreign Application Priority Data

Mar. 21, 2014 (DE) ..... 10 2014 205 344
Mar. 21, 2014 (DE) ..... 10 2014 205 354

(51) Int. Cl.

| | |
|---|---|
| ***F01L 1/34*** | (2006.01) |
| ***F01L 13/00*** | (2006.01) |
| ***F01L 1/344*** | (2006.01) |
| ***F01L 9/02*** | (2006.01) |
| *F01L 1/047* | (2006.01) |

(52) U.S. Cl.

CPC ..... *F01L 13/0021* (2013.01); *F01L 1/3442* (2013.01); *F01L 9/025* (2013.01); *F01L 1/34416* (2013.01); *F01L 2001/0473* (2013.01); *F01L 2001/34423* (2013.01)

(58) Field of Classification Search

CPC ..... F01L 13/0021; F01L 1/3442; F01L 9/025; F01L 2001/34423; F01L 1/34416; F01L 2001/0473

See application file for complete search history.

(56) References Cited

U.S. PATENT DOCUMENTS

| | | | | |
|---|---|---|---|---|
| 6,148,778 | A | 11/2000 | Sturman | |
| 8,141,528 | B2 * | 3/2012 | Schneider | F01L 1/047 123/90.17 |
| 2005/0061289 | A1 * | 3/2005 | Plenzler | F01L 1/022 123/196 M |
| 2007/0062193 | A1 | 3/2007 | Weber et al. | |
| 2013/0133596 | A1 | 5/2013 | Stucchi et al. | |

FOREIGN PATENT DOCUMENTS

| | | | |
|---|---|---|---|
| DE | 10212327 | A1 | 3/2003 |
| DE | 102004044996 | A1 | 4/2005 |
| DE | 102010008958 | A1 | 10/2010 |
| WO | 2005052417 | A2 | 6/2005 |
| WO | 2008095459 | A1 | 8/2008 |

* cited by examiner

*Primary Examiner* — Zelalem Eshete
(74) *Attorney, Agent, or Firm* — Greg Brown; McCoy Russell LLP

(57) ABSTRACT

A system and method is provided for an at least partially variable valve drive in an internal combustion engine. In one example, the at least partially variable valve drive comprises a hydraulically adjustable actuating device which may be charged with pressurized oil via an oil pressure line which branches off from an oil circuit.

20 Claims, 5 Drawing Sheets

APPLIED-IGNITION INTERNAL COMBUSTION ENGINE WITH VARIABLE VALVE DRIVE

CROSS REFERENCE TO RELATED APPLICATIONS

The present application claims priority to German Patent Application No. 102014205344.7, filed Mar. 21, 2014, and German Patent Application No. 102014205354.4, filed Mar. 21, 2014, the entire contents of each of which are hereby incorporated by reference for all purposes.

FIELD

The present disclosure relates a method and system of an internal combustion engine with an at least partially variable valve drive.

BACKGROUND\SUMMARY

Variable valve drives are utilized in vehicles with internal combustion engines to control the timing of engine cylinder valves in order to raise engine performance, increase fuel economy, and reduce emissions. Variable valve drives can be hydraulically controlled, an electronic controller of a powertrain control module directing high pressure oil to actuate oil pressure cams for altering valve timing.

The inventors herein have recognized various issues with the above system. For example, fully variable valve drives are expensive. Known partially variable valve drives may not provide individual control of the valves in order to optimize engine efficiency and the combustion process, and/or may not provide sufficient oil pressure to generate sufficient torque at different operating conditions.

One approach that at least partially addresses the above issues is a partially variable valve drive system comprising at least one cylinder head with at least one cylinder, each cylinder having at least two inlet openings for the supply of fresh air via an intake system and/or at least two outlet openings for the discharge of the exhaust gases via an exhaust-gas discharge system, a pump for delivering engine oil, the pump serving for supplying engine oil to the internal combustion engine, thus forming an oil circuit, and at least two at least partially variable valve drives having at least two valves which are movable between a valve closed position and a valve open position in order to open up and block the at least two inlet or outlet openings of a cylinder, having valve spring means for preloading the valves in the direction of the valve closed position, and having at least two hydraulically adjustable actuating devices for opening the valves counter to the preload force of the valve spring means, each actuating device comprising a cam which is arranged on a camshaft and which, as the camshaft rotates, can be brought into engagement with at least one cam follower element, whereby the associated valve can be actuated, wherein each hydraulically adjustable actuating device can be charged with pressurized oil via an oil pressure line which branches off from the oil circuit, there being arranged in the oil pressure line a controllable shut-off element which blocks or opens up the oil pressure line), and the cams of the at least two hydraulically adjustable actuating devices of the at least two at least partially variable valve drives are rotatable.

In this way, it may be possible to achieve a fully flexible valve train wherein individual control and actuation of each valve may be achieved via separate oil pressure lines. Further, this system provides a modular oil pressure actuated variable valve actuation which may be combined with a cam-in-cam system or a camshaft profile switching system, providing optimized, individual, variable valve lift and/or timing and a support system for providing sufficient oil pressure.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
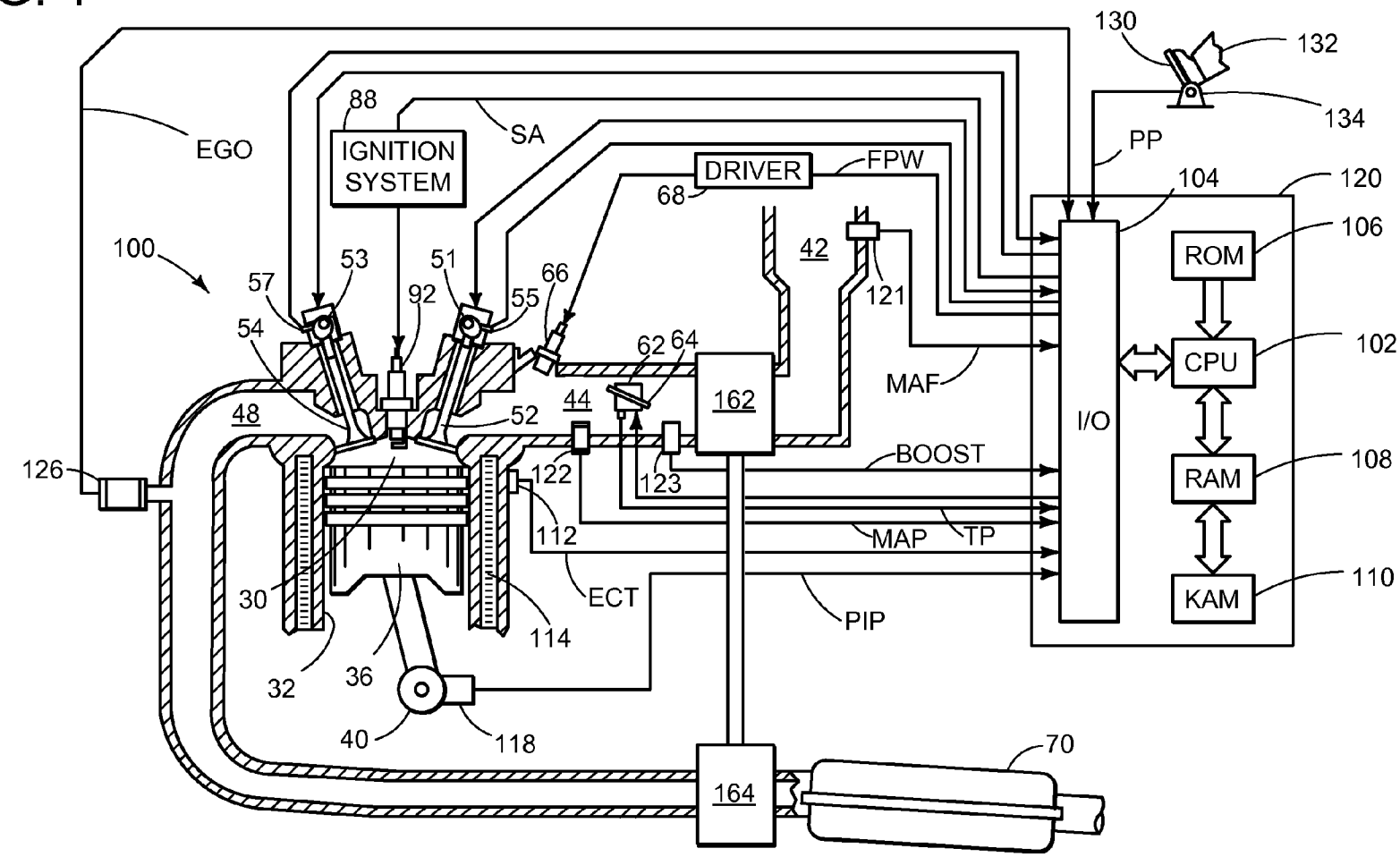
FIG. 1 shows an example engine diagram.

The present disclosure relates to an applied-ignition internal combustion engine comprising at least one cylinder head with at least one cylinder, each cylinder having at least two inlet openings for the supply of fresh air via an intake system and/or at least two outlet openings for the discharge of the exhaust gases via an exhaust-gas discharge system, a pump for delivering engine oil, the pump serving for supplying engine oil to the internal combustion engine, thus forming an oil circuit, and at least two at least partially variable valve drives having at least two valves which are movable between a valve closed position and a valve open position in order to open up and block the at least two inlet or outlet openings of a cylinder, having valve spring means for preloading the valves in the direction of the valve closed position, and having at least two hydraulically adjustable actuating devices for opening the valves counter to the preload force of the valve spring means, each actuating device comprising a cam which is arranged on a camshaft and which, as the camshaft rotates, can be brought into engagement with at least one cam follower element, whereby the associated valve can be actuated.

An internal combustion engine of the above-stated type is used as a drive for motor vehicles. Within the context of the present disclosure, the expression "internal combustion engine" encompasses Otto-cycle engines and also hybrid internal combustion engines, which utilize a hybrid combustion process, and hybrid drives which comprise not only the internal combustion engine but also an electric machine which can be connected in terms of drive to the internal combustion engine and which receives power from the internal combustion engine or which, as a switchable auxiliary drive, additionally outputs power.

Internal combustion engines have a cylinder block and at least one cylinder head which are connected to one another to form the individual cylinders, that is to say combustion chambers. To hold the pistons or the cylinder liners, the cylinder block has a corresponding number of cylinder bores. The cylinder head conventionally serves to hold the valve drive. To control the charge exchange, an internal combustion engine requires control elements and actuating devices for actuating the control elements. During the charge exchange, the combustion gases are discharged via the outlet openings and the charging of the combustion chamber, that is to say the induction of the fresh air, takes place via the inlet openings. To control the charge exchange, in four-stroke engines, use is made almost exclusively of lifting valves as control elements, which lifting valves perform an oscillating lifting movement during the operation of the internal combustion engine and which lifting valves open and close the inlet and outlet openings in this way. The actuating device required for the movement of a valve, including the valve itself, is referred to as the valve drive.

An actuating device comprises a camshaft on which cams are arranged. A basic distinction is made between an underlying camshaft and an overhead camshaft. This relates to the parting plane between the cylinder head and cylinder block. If the camshaft is arranged above said parting plane, it is an overhead camshaft, otherwise it is an underlying camshaft.

Overhead camshafts are likewise mounted in the cylinder head, wherein a valve drive with overhead camshaft may additionally, as a further valve drive component, have a rocker lever, a finger-type rocker, a tilting lever and/or a tappet. Said cam follower elements are situated in the force flow between cam and valve.

It is the object of the valve drive to open and close the at least one inlet and/or outlet opening of a cylinder at the correct times, with a fast opening of the largest possible flow cross sections being sought in order to keep the throttling losses in the inflowing and outflowing gas flows low and in order to better enable charging of the cylinder and a complete discharge of the exhaust gases. According to the prior art, therefore, a cylinder may be also often and increasingly provided with two or more inlet and outlet openings.

According to the prior art, the intake lines which lead to the inlet openings, and the exhaust lines which adjoin the outlet openings, may be at least partially integrated in the cylinder head.

In the development of internal combustion engines, it is a basic aim to minimize fuel consumption, wherein the emphasis in the efforts being made is on obtaining an improved overall efficiency.

Fuel consumption and thus efficiency pose a potential issue in particular in the case of Otto-cycle engines, that is to say in the case of applied-ignition internal combustion engines. The reason for this lies in the principle of the operating process of the Otto-cycle engine. Load control may be generally carried out by means of a throttle flap provided in the intake system. By adjusting the throttle flap, the pressure of the inducted air downstream of the throttle flap can be reduced to a greater or lesser extent. The further the throttle flap is closed, that is to say the more said throttle flap blocks the intake system, the higher the pressure loss of the inducted air across the throttle flap, and the lower the pressure of the inducted air downstream of the throttle flap and upstream of the inlet into the at least one cylinder, that is to say combustion chamber. For a constant combustion chamber volume, it may be possible in this way for the air mass, that is to say the quantity, to be set by means of the pressure of the inducted air. This also explains why quantity regulation has proven to be disadvantageous specifically in part-load operation, because low loads require a high degree of throttling and a pressure reduction in the intake system, as a result of which the charge exchange losses increase with decreasing load and increasing throttling.

To reduce the described losses, various strategies for dethrottling an Otto-cycle engine have been developed.

One approach to a solution for dethrottling the Otto-cycle engine may be for example an Otto-cycle engine operating process with direct injection. The direct injection of the fuel may be a suitable means for realizing a stratified combustion chamber charge. The direct injection of the fuel into the combustion chamber thus permits quality regulation in the Otto-cycle engine, within certain limits. The mixture formation takes place by direct injection of the fuel into the cylinder or into the air situated in the cylinder, and not by external mixture formation, in which the fuel is introduced into the inducted air in the intake system.

Another option for dethrottling a multi-cylinder internal combustion engine may be offered by cylinder deactivation, that is to say the deactivation of individual cylinders in certain load ranges. The efficiency in part-load operation may be increased, by means of such partial deactivation because the deactivation of one cylinder of a multi-cylinder internal combustion engine increases the load on the other cylinders, which remain in operation, if the engine power remains constant, such that, in the case of Otto-cycle engines, the throttle flap can or must be opened further in order to introduce a greater air mass into said cylinders, whereby dethrottling of the internal combustion engine may be attained overall. During the partial deactivation, the cylinders which are permanently in operation operate in the region of higher loads, at which the specific fuel consumption may be lower. The load collective may be shifted toward higher loads. The cylinders which remain in operation during the partial deactivation furthermore exhibit improved mixture formation owing to the greater air mass or mixture mass supplied. Additional advantages with regard to efficiency may be attained in that a deactivated cylinder, owing to the absence of combustion, may not generate any wall heat losses owing to heat transfer from the combustion gases to the combustion chamber walls.

A further approach to a solution for optimizing the combustion process of an Otto-cycle engine consists in the use of an at least partially variable valve drive. By contrast to conventional valve drives, in which both the lift of the valves and also the timing may be invariable, these parameters which have an influence on the combustion process, and thus on fuel consumption, can be varied to a greater or lesser extent by means of variable valve drives. If the valve drive is partially variable or switchable and, for example, the closing time of the inlet valve and the inlet valve lift can be varied, this alone may make throttling-free and thus loss-free load control possible. The mixture mass or charge air mass which flows into the combustion chamber during the intake process may be then controlled not by means of a throttle flap but rather by means of the inlet valve lift and the opening duration of the inlet valve. Fully variable valve drives may be very expensive, for which reason use is often made of partially variable or switchable valve drives. Within the context of the present application, switchable valve drives are regarded as partially variable valve drives.

The applied-ignition internal combustion engine to which the present application relates has at least two at least partially variable valve drives, comprising at least two valves which are movable between a valve closed position and a valve open position in order to open up or block the at least two inlet or outlet openings of a cylinder, valve spring means for preloading the valves in the direction of the valve closed position, and at least two hydraulically adjustable actuating devices for opening the valves counter to the preload force of the valve spring means, wherein each actuating device comprises a cam which is arranged on a camshaft and which, as the camshaft rotates, can be brought into engagement with at least one cam follower element, whereby the associated valve can be actuated.

According to the present application, use is made of a hydraulically adjustable actuating device which uses pressurized oil to realize the variability of the valve drive. This has numerous advantages. Firstly, oil is an operating fluid of the internal combustion engine, and is therefore already available. Secondly, every internal combustion engine generally has an oil circuit with components, such as a pump, an oil cooler and a filter, which may be utilized to form the oil supply for the hydraulically adjustable actuating device. In this connection, it must be noted that only the variability of the valve drive may be implemented hydraulically, and the valve drive itself may be a mechanical valve drive in which a cam arranged on a rotating camshaft is brought into engagement with at least one cam follower element, which in turn exerts positive control over a valve. In this respect, the hydraulic actuating device is a hydraulically adjustable actuating device.

A hydraulically adjustable actuating device in some approaches may be for example a hydraulically actuated camshaft adjuster by means of which a camshaft can be rotated relative to the crankshaft, whereby the timing of the valves can be retarded or advanced while maintaining the same valve opening duration.

Against the background of that stated above, it is the object of the present application to provide an applied-ignition internal combustion engine according to the preamble of claim 1, which is optimized with regard to the at least two at least partially variable valve drives.

It is a further sub-object to specify a method for operating an internal combustion engine of said type.

The first sub-object is achieved by means of an applied-ignition internal combustion engine comprising at least one cylinder head with at least one cylinder, each cylinder having at least two inlet openings for the supply of fresh air via an intake system and/or at least two outlet openings for the discharge of the exhaust gases via an exhaust-gas discharge system, a pump for delivering engine oil, the pump serving for supplying engine oil to the internal combustion engine, thus forming an oil circuit, and at least two at least partially variable valve drives having at least two valves which are movable between a valve closed position and a valve open position in order to open up and block the at least two inlet or outlet openings of a cylinder, having valve spring means for preloading the valves in the direction of the valve closed position, and having at least two hydraulically adjustable actuating devices for opening the valves counter to the preload force of the valve spring means, each actuating device comprising a cam which is arranged on a camshaft and which, as the camshaft rotates, can be brought into engagement with at least one cam follower element, whereby the associated valve can be actuated, which internal combustion engine is distinguished by the fact that each hydraulically adjustable actuating device can be charged with pressurized oil via an oil pressure line which branches off from the oil circuit, there being arranged in the oil pressure line a controllable shut-off element which blocks or opens up the oil pressure line, and the cams of the at least two hydraulically adjustable actuating devices of the at least two at least partially variable valve drives are rotatable.

According to the present application, the inlet valves and/or outlet valves of each cylinder may be actuated, that is to say controlled, individually. Each valve of a cylinder and thus each valve of the internal combustion engine may be assigned individual timing, and/or an individual lift. The valves of a cylinder or of a group of cylinders may also be deactivated at the inlet side and/or at the outlet side, for example in the context of partial deactivation. Furthermore, it is also possible for only one inlet valve of two or more inlet valves of a cylinder or one outlet valve of two or more outlet valves of a cylinder to be deactivated, that is to say disabled, or switched.

According to the present application, the at least two at least partially variable valve drives may be variable or switchable in two ways. In this way, the variability of the valve drive and the number of degrees of freedom during the operation of the internal combustion engine may be increased.

Firstly, the hydraulically adjustable actuating device of a valve can be charged with pressurized oil via an oil pressure line, specifically through the control of a shut-off element arranged in the oil pressure line. In this context, it is possible to realize embodiments in which the actuating device of each valve may be individually controllable, or the outlet-side and/or inlet-side actuating devices of the at least two valves of a cylinder may be jointly modified, that is to say transformed, through the control of a common shut-off element in order to implement, that is to say realize, the variability of the associated valve drive.

Secondly, the cams of the at least two hydraulically adjustable actuating devices of the at least two at least partially variable valve drives may be rotatable. In the context of the present application, this means that the cams are rotatable even when the crankshaft may be stationary, specifically in the following way.

The cams may be rotated conjointly and similarly relative to the crankshaft, in the manner of a camshaft adjuster, whereby the timing of the valves may be retarded or advanced while maintaining the same valve opening duration.

The cams may however also be rotated relative to one another, that is to say adjusted in opposite directions of rotation, with only one cam or all of the cams being rotated relative to the crankshaft. In this case, with the same valve opening duration of each valve being maintained, the timings of the valves may be shifted relative to one another such that the cylinder may be opened for a longer or shorter time at the inlet side and/or at the outlet side, that is to say is connected for a longer or shorter time to the intake system and/or to the exhaust-gas discharge system.

According to the present application, at least two at least partially variable valve drives may be provided at the outlet side and/or at the inlet side of least one cylinder, that is to say the internal combustion engine may also comprise valves which may be actuated by means of a conventional valve drive and which have invariable timing and an invariable lift.

The internal combustion engine according to the present application achieves the object on which the application is based, specifically that of providing an applied-ignition internal combustion engine which is optimized with regard to the at least two at least partially variable valve drives.

Further advantageous embodiments of the internal combustion engine according to the present application will be explained in conjunction with the subclaims.

In the case of applied-ignition internal combustion engines in which each cylinder has at least two inlet openings, embodiments may be advantageous wherein the inlet valves of the at least two inlet openings of at least one cylinder belong in each case to an at least partially variable valve drive.

In the present case, all of the inlet valves of a cylinder may be part of a variable valve drive. Each inlet valve of the at least one cylinder may be assigned individual timing and/or an individual lift. The timing and/or the lift of the inlet valves may however also be varied similarly. Embodiments of the applied-ignition internal combustion engine may be advantageous in which the cams are rotatable relative to one another.

In the present case, the timings of the valves can be shifted relative to one another while maintaining the valve opening duration of each valve, such that the opening duration of the associated cylinder at the inlet side and/or at the outlet side can be lengthened or shortened. The valve overlap of the valves can be varied, whereby fuel consumption can be lowered, and stability during idle running may be increased.

This adjustment facility requires at least one rotatable cam. In a first alternative, a cam which is designed to be adjustable may be rotated relative to the crankshaft, whereas the at least one other cam may be designed as an immovable, static cam. In a second alternative, the at least two cams may be designed as adjustable cams which are rotatable relative to one another and relative to the crankshaft.

In this connection, embodiments of the internal combustion engine may be advantageous in which the cams are arranged on an at least two-part camshaft which comprises at least two camshaft sections that are rotatable relative to one another, wherein at least one cam is arranged on a first camshaft section and at least one cam is arranged on a second camshaft section. An example of a camshaft of the above type is described in German laid-open specification DE 10 2010 008 958 A1.

Here, embodiments of the applied-ignition internal combustion engine may be advantageous in which the at least two-part camshaft comprises, as first camshaft section, a hollow shaft and, as second camshaft section, a shaft arranged rotatably in the hollow shaft.

In the case of internal combustion engines with a crankshaft which is at least connectable in terms of drive to the camshaft, embodiments may also be advantageous in which the cams are rotatable with one another and relative to the crankshaft.

In the present case, the cams are, as in the case of a camshaft adjuster, rotated conjointly and similarly relative to the crankshaft. In this way, the timings of the associated valves are retarded or advanced while maintaining the respective valve opening duration.

Embodiments of the applied-ignition internal combustion engine may be advantageous in which each hydraulically adjustable actuating device has a separate oil pressure line which branches off from the oil circuit and via which the actuating device can be charged with pressurized oil, there being arranged in the separate oil pressure line a controllable shut-off element which blocks or opens up the separate oil pressure line.

In one example, each hydraulically adjustable actuating device of an at least partially variable valve drive may be equipped with a dedicated, separate oil pressure line, and thus each hydraulically adjustable actuating device is assigned a dedicated controllable shut-off element. Each associated valve can then, for example during the course of a charge exchange, be actuated with individual timing and/or an individual lift. In one example, the at least two inlet valves and/or outlet valves of the cylinder can be assigned different timing and/or a different lift.

Embodiments of the applied-ignition internal combustion engine may also be advantageous in which the hydraulically adjustable actuating devices of the at least two at least partially variable valve drives of a cylinder have a common oil pressure line which branches off from the oil circuit and via which the actuating devices can be charged with pressurized oil, there being arranged in the common oil pressure line a controllable shut-off element which blocks or opens up the common oil pressure line.

The timing and/or the lift of the at least two valves of a cylinder may then be generally varied similarly, specifically if the valves have hydraulically adjustable actuating devices of similar construction. By contrast, if the valves are equipped with actuating devices of different construction, it may be possible for timing and/or lift to be varied independently of one another, that is to say differently, even in the case of a common oil pressure line, and thus a common shut-off element, being used.

In this case, embodiments of the applied-ignition internal combustion engine may be advantageous in which the common oil pressure line branches downstream of the controllable shut-off element, with a branch leading to each actuating device.

Embodiments of the applied-ignition internal combustion engine may be advantageous in which the valves of the at least two inlet openings and/or of the at least two outlet openings of each cylinder each belong to an at least partially variable valve drive. All of the inlet valves of all of the cylinders of the internal combustion engine may be part of an at least partially variable valve drive in one example.

In the case of applied-ignition internal combustion engines having at least two cylinders, embodiments may be advantageous in which at least two cylinders are configured in such a way as to form at least two groups with in each case at least one cylinder, the valves of the at least two inlet openings and/or of the at least two outlet openings of the at least one cylinder of a first group belonging in each case to an at least partially variable valve drive, and the valves of the at least two inlet openings and/or of the at least two outlet openings of the at least one cylinder of a second group belonging in each case to a non-variable valve drive.

This embodiment is suitable for applied-ignition internal combustion engines with partial deactivation, that is to say for internal combustion engines with at least two cylinders which form at least two groups each with at least one cylinder, in which one cylinder group may be configured as a cylinder group that can be switched in load-dependent fashion, that is to say can be deactivated when required.

Therefore, in this connection, embodiments of the applied-ignition internal combustion engine may also be advantageous in which the at least one cylinder of the second group is a cylinder that may be operational even during partial deactivation of the internal combustion engine, and the at least one cylinder of the first group may be configured as a cylinder which is switchable in load-dependent fashion.

That which has been stated above with regard to the inlet side of the internal combustion engine, that is to say for the inlet openings and the inlet valves, also applies analogously to the outlet side of the internal combustion engine, that is to say to the outlet openings and the outlet valves. The corresponding outlet-side embodiments will therefore be described briefly below, with reference also being made to the statements regarding the inlet sidecase of applied-ignition internal combustion engines in which each cylinder has at least two outlet openings, embodiments may be advantageous wherein the outlet valves of the at least two outlet openings of at least one cylinder belong in each case to an at least partially variable valve drive.

In this connection, embodiments of the applied-ignition internal combustion engine may be advantageous in which the actuating device of each outlet valve of an at least partially variable valve drive has a separate oil pressure line which branches off from the oil circuit and via which the actuating device can be charged with pressurized oil, there being arranged in the separate oil pressure line a controllable shut-off element which blocks or opens up the separate oil pressure line.

In the case of two or more outlet openings per cylinder, embodiments of the applied-ignition internal combustion engine may also be advantageous in which the actuating devices of the at least partially variable valve drives of the at least two outlet valves have a common oil pressure line which branches off from the oil circuit and via which the actuating devices can be charged with pressurized oil, there being arranged in the common oil pressure line a controllable shut-off element which blocks or opens up the common oil pressure line.

Embodiments of the applied-ignition internal combustion engine may be advantageous in which at least one cylinder block, which may be connected to the at least one cylinder head and which serves as an upper crankcase half, may be provided for holding a crankshaft in at least two bearings.

The crankcase may be complemented by the lower crankcase half which may be mounted on the upper crankcase half and which serves as an oil pan. Here, to hold the oil pan, that is to say the lower crankcase half, the upper crankcase half has a flange surface. In general, to seal off the oil pan or the crankcase with respect to the environment, a seal may be provided in or on the flange surface. The connection is often provided by means of screws.

Embodiments of the applied-ignition internal combustion engine may be thus advantageous in which an oil pan which can be mounted on the upper crankcase half and which serves as a lower crankcase half is provided for collecting the engine oil.

To hold and mount the crankshaft, at least two bearings may be provided in the crankcase, which bearings are generally of two-part design and comprise in each case one bearing saddle and one bearing cover which can be connected to the bearing saddle. The crankshaft is mounted in the region of the crankshaft journals which may be arranged spaced apart from one another along the crankshaft axis and are generally formed as thickened shaft extensions. Here, bearing covers and bearing saddles may be formed as separate components or in one piece with the crankcase, that is to say with the crankcase halves. Bearing shells may be arranged as intermediate elements between the crankshaft and the bearings.

The oil circuit serves for supplying the bearings with oil, with the pump supplying engine oil via a supply line to a main oil gallery, from which ducts lead to the at least two bearings. To form the so-called main oil gallery, a main supply duct may be often provided which is aligned along the longitudinal axis of the crankshaft. The main supply duct may be arranged above or below the crankshaft in the crankcase or else integrated into the crankshaft.

Therefore, embodiments of the applied-ignition internal combustion engine may also be advantageous in which the pump supplies engine oil via a supply line to a main oil gallery from which ducts lead to the at least two bearings, thus forming the oil circuit.

The pump which is provided may enable a sufficiently large delivery flow, that is to say a correspondingly high delivery volume, and a sufficiently high oil pressure in the oil circuit, in particular in the main oil gallery. Here, the friction in the bearings of the crankshaft makes a considerable contribution to the fuel consumption of the internal combustion engine.

The pressure in the oil circuit varies, wherein the oil pressure may change as a function of load and engine speed, for example. In the case of a non-variable oil pump, it may be generally the case that a relatively high oil pressure prevails in the presence of relatively high loads and relatively high engine speeds, and a low oil pressure prevails in the presence of low loads and low engine speeds. Depending on the nature of the respective consumer to which oil is to be supplied via the oil circuit, it may however be the case that a relatively high oil pressure may be required even in the presence of low loads and low engine speeds, and that a low oil pressure may be admissible in the presence of relatively high loads and relatively high engine speeds. Accordingly, in an internal combustion engine that is operating at idle, the oil pressure in the oil circuit may be so low that the hydraulic actuating device of a switchable valve drive or the spray oil cooling arrangement of a cylinder-specific piston can no longer be reliably supplied with oil or charged with the required oil pressure.

Therefore, as an oil pump, use may also be made of a variable oil pump, for example a vane-type pump, which, like a piston pump, acts in accordance with the displacement principle but, by contrast thereto, operates not in oscillating fashion and thus intermittently but by rotation and thus advantageously continuously. In a hollow cylinder which serves as a stator, there rotates a further cylinder which serves as a rotor, wherein the axis of rotation of the rotor may be arranged eccentrically with respect to the stator. In the rotor, multiple radially arranged slides may be mounted so as to be displaceable in translational fashion, which slides divide the space between the stator and rotor into multiple chambers. The delivery rate of the pump may be varied by adjustment of the eccentricity of the rotor, wherein an increased delivery rate leads to an elevated oil pressure at the pump outlet. An adjustment of the eccentricity may be realized, by means of an engine controller, through the use of an electrically controllable valve, wherein the valve opens up or blocks an oil pressure line to the vane-type pump, whereby the eccentricity of the rotor is influenced.

Vane-type pumps or variable oil pumps in general may be comparatively expensive and may therefore not always suitable for series use, that is to say may not always be an alternative for ensuring an adequately high oil pressure in all operating states of the internal combustion engine.

In one example, therefore, embodiments of the applied-ignition internal combustion engine may be advantageous in which an additional pump is arranged in the oil circuit.

The additional oil pump better enables an adequately large delivery flow and/or an adequately high oil pressure in the oil circuit. The two pumps may be connected in series or arranged in parallel. The additional pump enables that, even in the presence of low loads and/or low engine speeds, an adequately high oil pressure or minimum pressure prevails in the oil circuit such that even selected critical consumers may be permanently charged with an adequately high oil pressure.

The pump and/or the additional pump may be a non-variable oil pump or a variable oil pump, but is preferably a non-variable oil pump, which results in cost advantages.

Embodiments of the applied-ignition internal combustion engine may also be advantageous in which a further pump supplies engine oil via a supply line to a main oil gallery from which ducts lead to the at least two bearings, thus forming a further oil circuit, the oil circuit in which the pump is arranged being an oil circuit which may be separated or at least separable from the further oil circuit.

While the additional pump, like the pump, is arranged in the oil circuit, the further pump serves for delivering oil in another, further oil circuit which may be separate from the oil circuit.

If a further oil circuit supplies oil to a main oil gallery via a supply line, this makes it possible for selected consumers, which require an adequately high oil pressure even in the presence of low loads and/or low engine speeds, to be implemented in the oil circuit. In this case, the consumers may be divided between the two circuits and are arranged either in the oil circuit or in the further oil circuit. Then, the pump may be used for targetedly providing an adequately high oil pressure or supplying an adequately large delivery flow to those consumers which, according to the prior art, may be at risk of being undersupplied during idle operation or in the presence of low load and/or engine speed.

In this context, embodiments of the applied-ignition internal combustion engine may be advantageous in which the pump is, in order to be supplied with engine oil, at least connectable to a storage vessel via an infeed line.

The pump, the additional pump and the further pump may be a mechanically driven or an electrically driven pump.

Embodiments of the applied-ignition internal combustion engine may be advantageous in which the pump is a pump which may be driven and operational permanently during the operation of the internal combustion engine, for example even when the crankshaft is at a standstill.

Embodiments of the applied-ignition internal combustion engine may be advantageous in which the pump supplies engine oil to an oil-type cooling means of a piston associated with the at least one cylinder.

Embodiments of the applied-ignition internal combustion engine may be advantageous in which each actuating device of the at least two at least partially variable valve drives comprises at least one switchable, unilaterally mounted rocker arm.

If the hydraulically adjustable actuating device of an at least partially variable valve drive comprises a rocker arm, said rocker arm may be of multi-part form, that is to say may comprise multiple, for example, two lever elements, wherein the elements are either rigidly connected to one another by a locking means, for example by means of a locking pin, or are separated from one another and are at least regionally movable relative to one another. The actuation of the locking means and thus the switching of the rocker arm may be then performed hydraulically, that is to say by means of oil pressure, or specifically by the absence of said oil pressure. In this way, it may be possible, for example, for the maximum valve lift to be varied, wherein, for example, one of the two lifts may be zero.

Embodiments of the applied-ignition internal combustion engine may be basically advantageous in which the at least two at least partially variable valve drives are valve drives that are switchable in two-stage fashion, such that two valve lifts of different magnitude can be realized.

The second sub-object on which the present application is based, specifically that of specifying a method for operating an applied-ignition internal combustion engine of a type specified above, may be achieved by means of a method for operating an internal combustion engine which is equipped with a valve drive which is switchable in two-stage fashion and in which a first valve lift is zero, which method is distinguished by the fact that, proceeding from operation with a second valve lift, by switching the valve drive to operation with the first valve lift, a switch is made so as to deactivate the associated valve of the valve drive or of the internal combustion engine.

That which has been stated in connection with the internal combustion engine according to the present application likewise applies to the method according to the present application.

A method of said type may be suitable for example for an applied-ignition internal combustion engine, and a method as described in the German patent application with the file reference 10 2014 200 573.6.

The present application will be described in more detail below on the basis of two exemplary embodiments of the internal combustion engine according to FIGS. 1, 2*a*, 2*b* and 3. In the figures:

Referring specifically to FIG. 1, it includes a schematic diagram showing one cylinder of multi-cylinder internal combustion engine 100. Engine 100 may be controlled at least partially by a control system including controller 120 and by input from a vehicle operator 132 via an input device 130. In this example, input device 130 includes an accelerator pedal and a pedal position sensor 134 for generating a proportional pedal position signal PP.

Combustion cylinder 30 of engine 100 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 100.

Figure 3A:
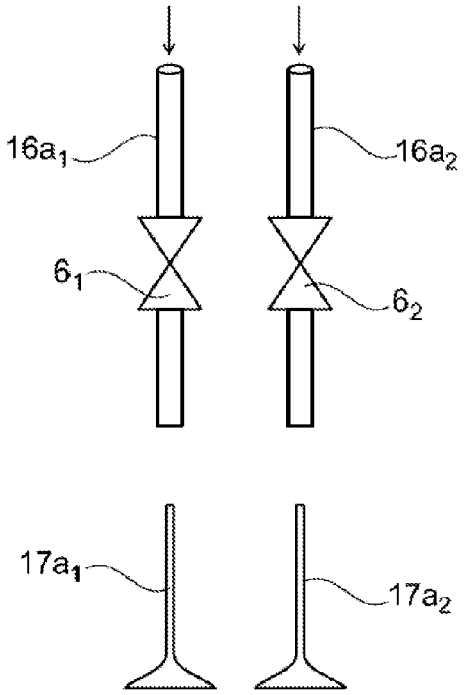
FIG. 3A schematically shows two valves of a cylinder, together with oil pressure line, of a first embodiment of the applied-ignition internal combustion engine.
Figure 3B:
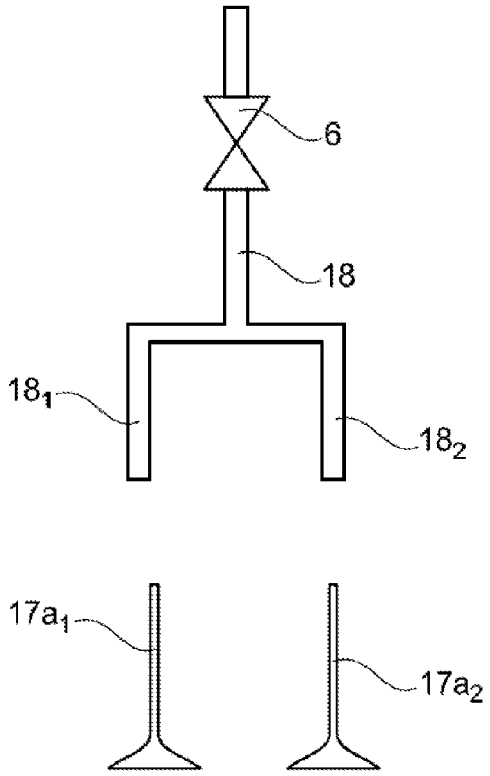
FIG. 3B schematically shows two valves of a cylinder, together with oil pressure line, of a second embodiment of the applied-ignition internal combustion engine.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves, such as shown in FIGS. 3A and 3B.

Figure 4:
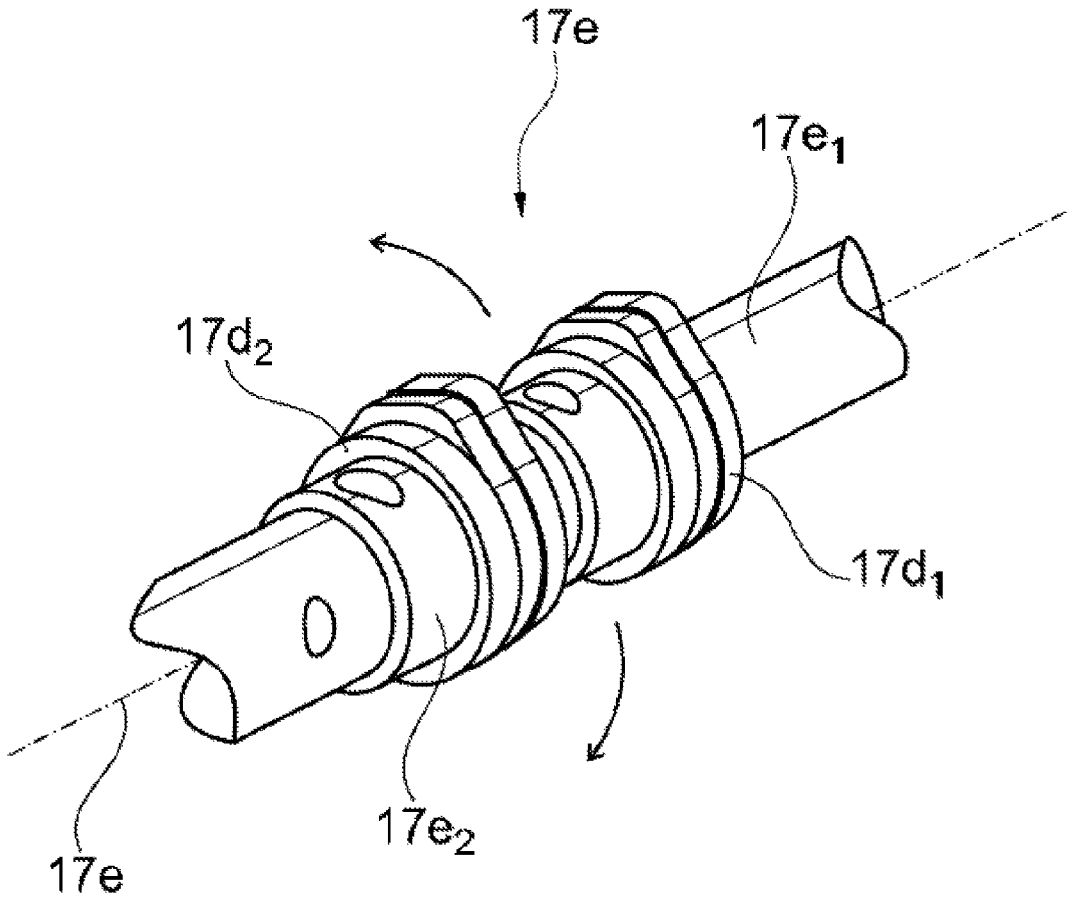
FIG. 4 schematically shows the fragment of a camshaft of an embodiment of the applied-ignition internal combustion engine.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), cam-in-cam (CiC), variable cam timing (VCT), variable valve timing (VVT) and/or variable valve lift (VVL) systems that may be operated by controller 120 to vary valve operation. In one example the actuation system may a hydraulically adjustable actuating device via separate oil lines and/or galleries, such as the one elaborated on in FIG. 2. Additionally and/or alternatively, the system may provide separate switching galleries to apply cam profile switching on all intake or all exhaust valves of at least one cylinder to provide selective cylinder deactivation. The position of intake valve 52 and exhaust valve 54 may be determined by position sensors 55 and 57, respectively or via camshaft sensors. The camshaft structure is shown in FIG. 4.

Combustion cylinder 30 includes a fuel injector 66 arranged in intake passage 42 in a configuration that provides what is known as port injection of fuel into the intake port upstream of combustion cylinder 30. Fuel injector 66 injects fuel therein in proportion to the pulse width of signal FPW received from controller 120 via electronic driver 68. Alternatively or additionally, in some embodiments the fuel injector may be mounted on the side of the combustion cylinder or in the top of the combustion cylinder, for example, to provide what is known as direct injection of fuel into combustion cylinder 30. Fuel may be delivered to fuel injector 66 by a fuel delivery system (not shown) including a fuel tank, a fuel pump, and a fuel rail.

Intake passage 42 may include a throttle 62 having a throttle plate 64. In this particular example, the position of throttle plate 64 may be varied by controller 120 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 121 and a manifold air pressure sensor 122 for providing respective signals MAF and MAP to controller 120.

Ignition system 88 can provide an ignition spark to combustion chamber 30 via spark plug 92 in response to spark advance signal SA from controller 120, under select operating modes. Though spark ignition components are shown, in some embodiments, combustion chamber 30 or one or more other combustion chambers of engine 100 may be operated in a compression ignition mode, with or without an ignition spark.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 120 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 120 may receive various signals and information from sensors coupled to engine 100, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Storage medium read-only memory 106 can be programmed with computer readable data representing instructions executable by processor 102 for performing the methods described below as well as variations thereof. The engine cooling sleeve 114 may be coupled to a cabin heating system.

Engine 100 may further include a compression device such as a turbocharger or supercharger including at least a compressor 162 arranged along intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression (e.g., boost) provided to one or more cylinders of the engine via a turbocharger or supercharger may be varied by controller 120. Further, a sensor 123 may be disposed in intake manifold 44 for providing a BOOST signal to controller 120.

Figure 2:
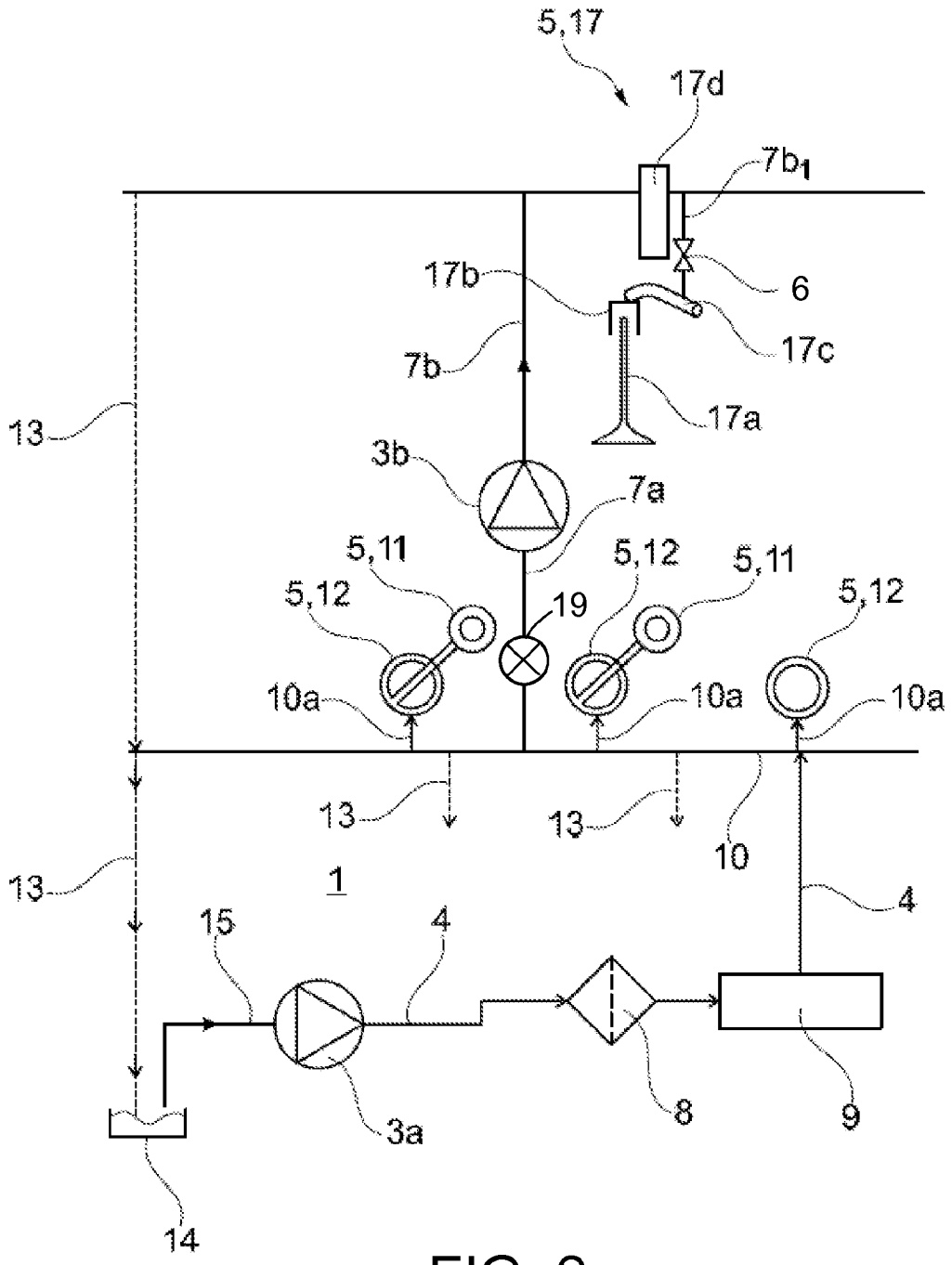
FIG. 2 schematically shows the fragment of an oil supply of an embodiment of the applied-ignition internal combustion engine.

FIG. 2 schematically shows the fragment of an oil supply of an embodiment of the applied-ignition internal combustion engine.

A pump 3*a* may be provided for delivering the engine oil through the oil circuit 1, wherein a suction line 15 leads from the oil pan 14, which serves for collecting and storing the engine oil, to the pump 3*a* in order to supply engine oil originating from the oil pan 14 to the pump 3*a*.

The pump 3*a* delivers the oil via a supply line 4 to the consumers 5 provided in the oil circuit 1. Here, the oil firstly flows through a filter 8 arranged downstream of the pump 3*a* and through a coolant-operated oil cooler 9 which may be arranged downstream of the filter 8, said oil cooler generally being deactivated during the warm-up phase.

Downstream, the supply line 4 issues into the main oil gallery 10, from which ducts 10*a* lead to consumers 5, in the present case to the main bearings 12 of the crankshaft and to the crankshaft-side connecting rod bearings 11, in order to supply oil to these. Return lines 13 also branch off from the main oil gallery 10, which return lines conduct the engine oil back into the oil pan 14 under the force of gravity.

Furthermore, an infeed line 7*a* leads from the main oil gallery 10, which is arranged in the cylinder block, to an additional pump 3*b* which, via oil pressure line 7*b*, supplies pressurized oil to further consumers 5. Said pump 3*b* serves for delivering engine oil and, in the present case, supplies oil to the hydraulically adjustable actuating device of a partially variable valve drive 17, specifically of a switchable valve drive 17. A solenoid valve 19 may be upstream of partially variable valve drive 17, and may be directly upstream of pump 3*b*. The solenoid valve may receive a signal from an engine controller to provide high or low pressure to oil line 7*b* and oil line $7b_1$.

The hydraulically adjustable actuating device of the valve drive 17 comprises a switchable, unilaterally mounted rocker arm 17*c* which, as the cam 17*d* rotates, is deflected and brought into engagement with a tappet 17*b* which, as a cam follower element, is mounted on that end of the valve 17*a* which faces away from the combustion chamber, such that the tappet 17*b* participates in the oscillating lifting movement of the valve 17*a* when the cam 17*d*, by way of its cam shell surface in the region of the cam lug, is in engagement with and deflects the rocker arm 17*c*.

The rocker arm 17*c* may be of two-part form, wherein the two lever elements may be rigidly connected to one another by means of a locking pin, or may be separated from one another and are then at least regionally movable relative to one another. The actuation of the pin and thus the switching of the rocker arm 17*c* may be performed hydraulically via a rocker arm-specific oil pressure line $7b_1$ which branches off from the oil pressure line 7*b* and in which a controlled shut-off element 6 is arranged. When the shut-off element 6 is in the open position, the locking pin is subjected to oil pressure, whereas, in the closed position, the pin is separated from the oil pressure line 7*b* and may not be subjected to pressure.

In this way, the lift of the valve 17*a*, that is to say the maximum lift, can be varied by means of oil pressure, wherein a first lift may be realized when the locking pin is subjected to oil pressure, and a second lift may be realized when the locking pin is separated from the additional pump 3*b* and thus from the oil pressure.

FIG. 3A schematically shows the two inlet valves 17$a_1$, 17$a_2$ of a cylinder, together with oil pressure lines 16$a_1$, 16$a_2$, of a first embodiment of the applied-ignition internal combustion engine. It is sought to explain the additional features in relation to FIG. 2, for which reason reference is made otherwise to FIG. 2.

The inlet valves 17$a_1$, 17$a_2$ each belong to a partially variable valve drive 17, shut off two inlet openings of a cylinder, and open up said inlet openings during the charge exchange.

The hydraulically adjustable actuating device of each inlet valve 17$a_1$, 17$a_2$ has in each case a separate oil pressure line 16$a_1$, 16$a_2$ which branches off from the oil circuit and via which the actuating device can be charged with pressurized oil. In each separate oil pressure line 16$a_1$, 16$a_2$, there may be arranged a controllable shut-off element 6$_1$, 6$_2$ which blocks or opens up the separate oil pressure line 16$a_1$, 16$a_2$.

Each inlet valve 17$a_1$, 17$a_2$ can then, during the course of a charge exchange, be operated with individual timing and/or an individual lift. For example, the inlet valves 17$a_1$, 17$a_2$ of the cylinder can be assigned different timing and/or a different lift.

FIG. 3B schematically shows two inlet valves 17$a_1$, 17$a_2$ of a cylinder, together with oil pressure lines 18, 18$_1$, 18$_2$, of a second embodiment of the applied-ignition internal combustion engine. It is sought to explain only the differences in relation to the embodiment illustrated in FIG. 3A, for which reason reference is otherwise made to FIGS. 2 and 3A.

The actuating devices of the two inlet valves 17$a_1$, 17$a_2$ have a common oil pressure line 18 which branches off from the oil circuit 1 and via which the actuating devices can be charged with pressurized oil, there being arranged in the common oil pressure line 18 a controllable shut-off element 6 which blocks or opens up the common oil pressure line 18.

The timing and/or the lift of the inlet valves 17$a_1$, 17$a_2$ of the cylinder may be varied similarly. The common oil pressure line 18 branches downstream of the controllable shut-off element 6, with a branch 18$_1$, 18$_2$ leading to each actuating device of an inlet valve 17$a_1$, 17$a_2$.

FIG. 4 schematically shows the fragment of a camshaft 17*e* of a partially variable valve drive of an embodiment of the applied-ignition internal combustion engine.

The two cams 17$d_1$, 17$d_2$ that are illustrated may be rotatable relative to one another such that the valve overlap of the two associated inlet valves can be varied, that is to say increased or decreased.

For this purpose, the camshaft 17*e* on which the cams 17$d_1$, 17$d_2$ are arranged may be of two-part form. The camshaft 17*e* comprises two camshaft sections 17$e_1$, 17$e_2$ which may be rotatable relative to one another, wherein a first cam 17$d_1$ is arranged on the first camshaft section 17$e_1$ and a second cam 17$d_2$ is arranged on the second camshaft section 17$e_2$. The second camshaft section 17$d_2$ may be in the form of a hollow shaft, in which a shaft which serves as the first camshaft section 17$d_1$ is arranged and mounted in rotatable fashion.

Now, if the shaft is rotated together with the first cam 17$d_1$ about the longitudinal axis 17*e*' relative to the crankshaft and relative to the hollow shaft and thus also relative to the second cam 17$d_2$ arranged on the hollow shaft, or vice versa, this equates to a rotation of the two cams 17$d_1$, 17$d_2$ relative to one another. In this case, the hollow shaft together with the second cam 17$d_2$, or the shaft together with the first cam 17$d_1$, respectively, may remain in the same position.

Figure 5:
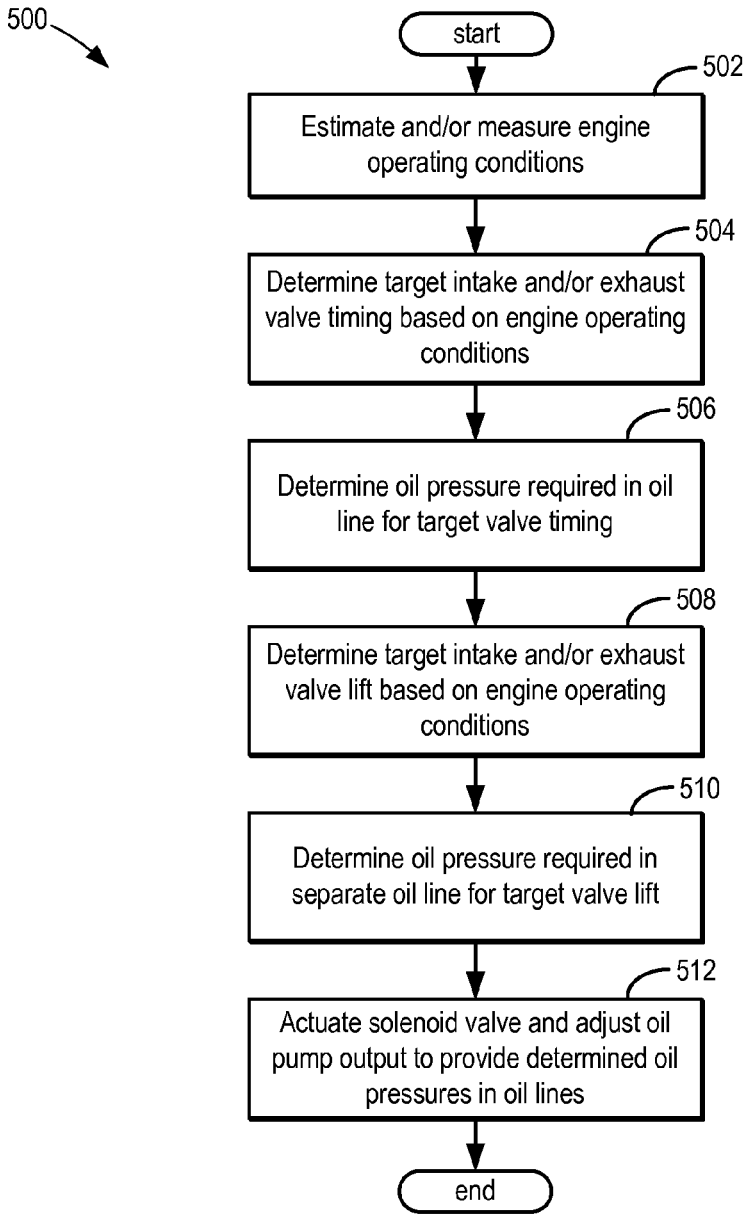
FIG. 5 shows a flow chart illustrating a method for operating an engine including a hydraulically actuated at least partially variable valve drive.

Turning now to FIG. 5, an example flowchart illustrating a method 500 for operating an engine, such as the engine in FIG. 1, is shown including a hydraulically actuated at least partially variable valve drive, such as depicted in FIG. 2. Method 500 may be carried out according to instructions stored in the non-transitory memory of a controller, such as controller 120.

At 502, engine operating conditions may be measured and/or estimated. The engine operating conditions may include engine speed, load, temperature, camshaft timing, camshaft profile, etc.

At 504, the target intake and/or exhaust valve timing is determined based on the engine operating conditions at 502. For example, a controller, such as controller 120, may have stored a speed and/or load table for which different cam profiles, valve timing, and valve lifts are profiled according to engine speed or load.

At 506, it may be determined the oil pressure required in the oil line for target valve timing determined at 504. The oil line may be oil line 7*b*, in one example, which may be fluidly communicating with a controllable shut-off valve, such as controllable shut-off element 6.

At 508, target intake and/or exhaust valve lift may be determined. In one example, this may include having instructions to deactivate cylinders to run the remaining cylinders at more efficient load points. In another example, this may include instructions do activate or deactivate individual valve lifts according to engine operating conditions and/or switching the valve lift of each valve to perform two different lift profiles which may be in a range between zero lift and maximum lift.

At 510, it may be determined the oil pressure required in the separate oil line for target valve lift. The oil line may be line 7$b_1$, in one example.

At 512, a solenoid valve, such as solenoid valve 19 of FIG. 2, may be actuated and a pump output, such as pump 3*a* and/or pump 3*b*, may be adjusted to provide determined oil pressures in oil lines 7*b* and/or 7$b_1$, for example. In this way, individual timing and/or lift may be realized for the inlet and exhaust valves. Oil feed may be provided to a number of valves in order to actuate or deactuate cam profile switching devices. Further, the valve lift of each valve pair (such as shown in FIGS. 3A and 3B) may be activated or deactivated or the valve lift of each valve of the pair can be switched to perform two different lift profiles which have to be in the range between zero lift and maximum lift. The cam-in-cam camshaft, such as the one shown in FIG. 4, may modulate the opening event of the valve pair, wherein the valve event of the first valve may be shifted in a certain range to advance or retard phase relative to the lift of the second valve. Furthermore, booster pump 3*b* may be provided for additional hydraulic power.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE SYMBOLS

1 Oil circuit
3*a* Pump
3*b* Additional pump
4 Supply line
5 Consumer
6 Controlled shut-off element
61 First shut-off element
62 Second shut-off element
7 Infeed line
7*b* Oil pressure line
7*b*1 Rocker arm-specific oil pressure line
8 Filter
9 Oil cooler
10 Main oil gallery
10*a* Duct
11 Crankshaft-side connecting rod bearing
12 Crankshaft bearing, main bearing
13 Recirculation line
14 Oil pan
15 Suction line
16*a*1 Separate oil pressure line
16*a*2 Separate oil pressure line
17 Switchable valve drive
17*a* Valve
17*a*1 First valve, inlet valve
17*a*2 Second valve, inlet valve
17*b* Tappet
17*c* Switchable rocker arm
17*d* Cam
17*d*1 First cam
17*d*2 Second cam
17*e* Camshaft
17*e*' Longitudinal axis of the camshaft
17*e*1 First camshaft section
17*e*2 Second camshaft section
18 Common oil pressure line
181 First branch
182 Second branch

The invention claimed is:

1. An applied-ignition internal combustion engine comprising:

at least one cylinder head with at least one cylinder, each cylinder having at least two inlet openings for the supply of fresh air via an intake system and/or at least two outlet openings for the discharge of exhaust gases via an exhaust-gas discharge system;

a first pump for supplying engine oil to the internal combustion engine, thus forming a first oil circuit;

at least two at least partially variable valve drives having at least two valves which are movable between a valve closed position and a valve open position in order to open up and block the at least two inlet or outlet openings of a cylinder, having valve spring means for preloading the valves in a direction of the valve closed position, and having at least two hydraulically adjustable actuating devices arranged in a second oil circuit for opening the valves counter to a preload force of the valve spring means, each actuating device comprising a cam which is arranged on a camshaft and which, as the camshaft rotates, can be brought into engagement with at least one cam follower element, whereby the associated valve can be actuated;

a second oil pump arranged in the second oil circuit upstream of the actuating devices; and a solenoid valve separating the first oil circuit from the second oil circuit, the solenoid valve arranged directly upstream from the second oil pump, wherein each hydraulically adjustable actuating device can be charged with pressurized oil via an oil pressure line which branches off from the second oil circuit downstream of the second pump, there being arranged in the oil pressure line a controllable shut-off element which blocks or opens up the oil pressure line, and wherein the cams of the at least two hydraulically adjustable actuating devices of the at least two at least partially variable valve drives are rotatable.

2. The applied-ignition internal combustion engine of claim 1, wherein the cams are rotatable relative to one another.

3. The applied-ignition internal combustion engine of claim 2, wherein the cams are arranged on an at least two-part camshaft which comprises at least two camshaft sections that are rotatable relative to one another, at least one cam being arranged on a first camshaft section and at least one cam being arranged on a second camshaft section.

4. The applied-ignition internal combustion engine of claim 3, wherein the at least two-part camshaft comprises, as the first camshaft section, a hollow shaft and, as the second camshaft section, a shaft arranged rotatably in the hollow shaft.

5. The applied-ignition internal combustion engine of claim 1, having a crankshaft which is at least connectable in terms of drive to the camshaft, wherein the cams are rotatable relative to one another, and wherein the cams are rotatable relative to the crankshaft even when the crankshaft is stationary.

6. The applied-ignition internal combustion engine of claim 1, wherein each hydraulically adjustable actuating device has a separate oil pressure line which branches off from the second oil circuit downstream of the second pump and via which the actuating device can be charged with pressurized oil, there being arranged in the separate oil pressure line a controllable shut-off element which blocks or opens up the separate oil pressure line.

7. The applied-ignition internal combustion engine of claim 1, wherein the hydraulically adjustable actuating devices of the at least two at least partially variable valve drives of a cylinder have a common oil pressure line which branches off from the second oil circuit downstream of the second pump and via which the actuating devices can be charged with pressurized oil, there being arranged in the common oil pressure line a controllable shut-off element which blocks or opens up the common oil pressure line.

8. The applied-ignition internal combustion engine of claim 7, wherein the common oil pressure line branches downstream of the controllable shut-off element, with a branch leading to each actuating device.

9. The applied-ignition internal combustion engine of claim 1, wherein the valves of the at least two inlet openings and/or of the at least two outlet openings of each cylinder each belong to an at least partially variable valve drive.

10. The applied-ignition internal combustion engine of claim 1, having at least two cylinders, wherein at least two cylinders are configured in such a way as to form at least two groups with in each case at least one cylinder, the valves of the at least two inlet openings and/or of the at least two outlet openings of the at least one cylinder of a first group belonging in each case to an at least partially variable valve drive, and the valves of the at least two inlet openings and/or of the at least two outlet openings of the at least one cylinder of a second group belonging in each case to a non-variable valve drive.

11. The applied-ignition internal combustion engine of claim 1, wherein at least one cylinder block, which can be connected to the at least one cylinder head and which serves as an upper crankcase half, is provided for holding a crankshaft in at least two bearings.

12. The applied-ignition internal combustion engine of claim 11, wherein the first pump supplies engine oil via a supply line to a main oil gallery from which ducts lead to the at least two bearings, thus forming the first oil circuit.

13. The applied-ignition internal combustion engine of claim 1, wherein each actuating device of the at least two at least partially variable valve drives comprises at least one switchable, unilaterally mounted rocker arm.

14. The applied-ignition internal combustion engine of claim 13, wherein each rocker arm is switchable in a two-stage fashion, such that two valve lifts of different magnitude can be realized.

15. A method for operating an engine, comprising:

operating a first pump to supply engine oil to a first oil circuit;

determining a target intake and/or exhaust valve timing and lift based on engine operating conditions;

determining an oil pressure required in an oil infeed line for target valve timing, the oil infeed line arranged in a second oil circuit downstream of a solenoid valve and upstream of a second pump, the first and second oil circuits separated by the solenoid valve;

determining an oil pressure required in an oil pressure line based on the determined target lift, the oil pressure line arranged in the second oil circuit downstream of the second pump and having a controllable shut-off element arranged therein;

actuating the solenoid valve and the second pump to provide the determined oil pressure required in the oil infeed line; and actuating the shut-off element to provide the determined oil pressure required in the oil pressure line.

16. The method of claim 15, further comprising adjusting output of the first and second oil pumps based on the determined oil pressures required in the oil infeed line and the oil pressure line.

17. A method for operating an engine, comprising:

operating a first pump to supply engine oil to a first oil circuit;

determining a target intake and/or exhaust valve timing and lift based on engine operating conditions;

determining an oil pressure required in an oil infeed line for target valve timing, the oil infeed line arranged in a second oil circuit downstream of a solenoid valve and upstream of a second pump, the first and second oil circuits separated by the solenoid valve;

determining an oil pressure required in a separate oil pressure line branching from an oil pressure line for target valve lift, the oil pressure line arranged in the second oil circuit downstream of the second pump and upstream of a cam-in-cam camshaft, the separate oil pressure line branching from the oil pressure downstream of the camshaft and having a controllable shut-off element arranged therein, the separate oil pressure line fluidly communicating with a switchable rocker arm of a hydraulically adjustable actuating device downstream of the shut-off element;

actuating the solenoid valve and the second pump to provide the determined oil pressure required in the oil infeed line; and actuating the shut-off element to provide the determined oil pressure required in the separate oil pressure line.

18. The method of claim 17, wherein there is no solenoid valve or shut-off element between the second pump and the camshaft.

19. The method of claim 17, wherein the first pump is driven and operational permanently during engine operation, even when an engine crankshaft is at a standstill.

20. The method of claim 17, wherein the rocker arm comprises two lever elements rigidly connectable to one another by a locking pin, wherein the target intake and/or exhaust valve lift is a maximum lift, the method further comprising adjusting the maximum lift by adjusting the shut-off element, wherein when the shut-off element is in an open position, the locking pin is subjected to oil pressure from the separate oil pressure line and a first maximum lift is realized, and wherein when the shut-off element is in a closed position, the locking pin is not subjected to oil pressure from the separate oil pressure line and a second maximum lift is realized.

* * * * *